US005195638A

United States Patent [19]

Zinbarg

[11] Patent Number: 5,195,638

[45] Date of Patent: Mar. 23, 1993

[54] COMBINATION OF THEMATICALLY RELATED DECORATIVE OBJECTS

[76] Inventor: Benson E. Zinbarg, 320 Chestnut Hill Road, Stamford, Conn. 06903

[21] Appl. No.: 749,165

[22] Filed: Aug. 23, 1991

Related U.S. Application Data

[63] Continuation-in-part of Ser. No. 554,967, Jul. 18, 1990, and Ser. No. 664,023, Mar. 4, 1991, and Ser. No. 664,024, Mar. 4, 1991.

[51] Int. Cl.[5] ..... B65D 33/00

[52] U.S. Cl. ..... 206/457; 52/4; 206/575; 428/8; 428/15

[58] Field of Search ..... 206/457, 575; 428/7-9, 428/13, 16, 19, 15; 52/3, 9, 311; D11/131, 160, 161; D21/176, 177, 179; 248/95

[56] References Cited

U.S. PATENT DOCUMENTS

D. 23,399 6/1894 Lee .
D. 39,516 9/1908 Prugh .
D. 47,064 3/1915 Adams .
D. 49,569 8/1916 Burtchaell .
D. 66,800 3/1925 Lehnert .
D. 74,183 1/1928 McEldowney .
D. 94,174 12/1934 Vogt .
D. 96,425 7/1935 Spanel .
D. 125,195 2/1941 Winsick .
D. 156,059 5/1949 Vivaudou .
D. 164,442 9/1951 Park .
D. 169,265 4/1953 Lavezzorio .
D. 183,667 10/1958 Treinis .
D. 186,410 10/1959 Collins .
D. 187,497 3/1960 Goldie .
D. 191,284 9/1961 O'Donnell .
D. 241,819 10/1976 Flecken .
D. 256,826 9/1980 Phillips .
D. 258,205 2/1981 Kroll .
D. 293,959 1/1988 Allen .
D. 310,023 8/1990 Dembiczak et al. .
D. 317,254 6/1991 Dembiczak et al. .
177,749 5/1876 Redden .
492,071 2/1893 Vaughan .
514,159 2/1894 Nelson .
764,207 7/1904 Robinson .

(List continued on next page.)

FOREIGN PATENT DOCUMENTS 39851 5/1907 Switzerland .
379876 9/1932 United Kingdom .

OTHER PUBLICATIONS

The Everything Book for Teachers of Young Children, Partner Press 1985.
Holiday Gifts, Favors and Decorations, Lothrop lee and Shepard Co. 1971.

*Primary Examiner*—Bryon P. Gehman
*Attorney, Agent, or Firm*—David P. Gordon

[57] ABSTRACT

Decorative structures comprising a combination of a flexible sheet member and a decorative bag member simulate a universal conception of the appearance of a well known theme. For example, a combination structure for simulating a universal conception of the appearance of a ghost and Halloween jack-o-lantern pumpkin comprises a flexible sheet member placed over a support bag member and having facial indicia simulating an appearance of a face of a ghost thereon, and a generally rounded bag for receiving filling material and having indicia simulating a pumpkin. The free ends of the sheet member are secured to the ground at spaced apart positions, to provide a substantially pyramidal or generally inverted conical shape, so that, if desired, the resultant structure can flutter when subjected to wind. The support bag member may be fixed to the ground, for example, by means of pegs.

21 Claims, 14 Drawing Sheets

U.S. PATENT DOCUMENTS

| | | | |
|---|---|---|---|
| 795,630 | 7/1905 | Lynn | 52/311 X |
| 824,071 | 6/1906 | Faber et al. . | |
| 850,672 | 4/1907 | Novak | 52/4 |
| 1,106,353 | 8/1914 | Adamec | 52/4 |
| 1,207,533 | 12/1916 | Gamble . | |
| 1,237,930 | 8/1917 | Malvern et al. . | |
| 1,287,154 | 12/1918 | Wells . | |
| 1,308,432 | 7/1919 | Lochridge . | |
| 1,536,816 | 5/1925 | Sale . | |
| 1,600,749 | 9/1926 | Barnes | 52/4 X |
| 1,649,770 | 11/1927 | Miller . | |
| 1,698,653 | 1/1929 | Poole . | |
| 1,950,539 | 3/1934 | Brownfield . | |
| 1,965,040 | 7/1934 | Kelly . | |
| 2,009,511 | 3/1936 | Nydegger . | |
| 2,112,477 | 3/1938 | Brownfield . | |
| 2,208,445 | 7/1940 | Bates | 428/9 |
| 2,460,963 | 2/1949 | Young . | |
| 2,682,903 | 7/1954 | Gay . | |
| 2,689,424 | 9/1954 | Clagett . | |
| 3,163,418 | 12/1964 | Myers . | |
| 3,195,265 | 7/1965 | Marquez et al. . | |
| 3,308,936 | 3/1967 | Roland et al. . | |
| 3,349,991 | 10/1967 | Kessler . | |
| 3,442,043 | 5/1967 | Panzer . | |
| 3,650,298 | 3/1972 | Delmar . | |
| 4,436,204 | 3/1984 | Sowinski . | |
| 4,445,230 | 4/1984 | Spadaro . | |
| 4,795,033 | 1/1989 | Duffy . | |
| 5,027,457 | 7/1991 | Sweet . | |

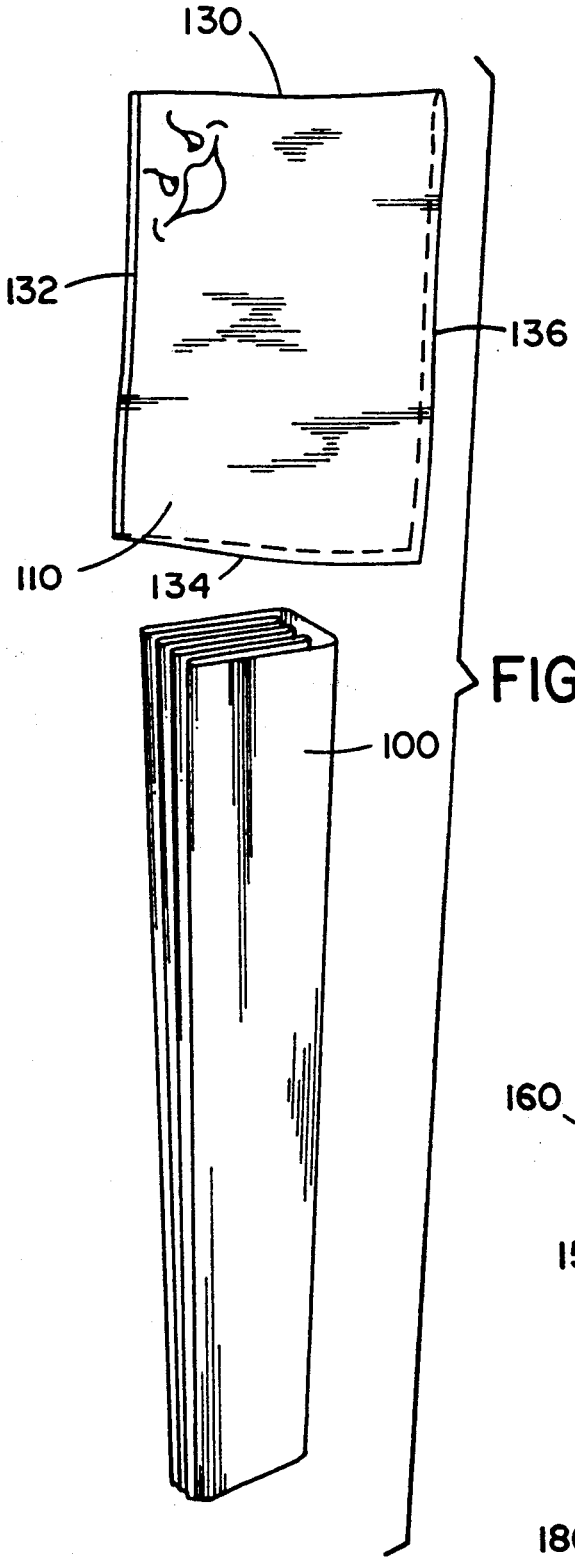
FIG. 9
FIG. 10
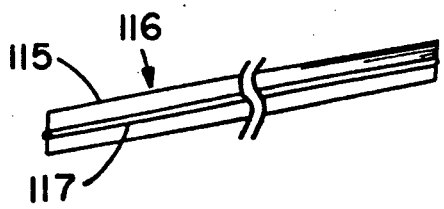
FIG. 11
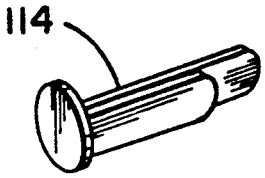
FIG. 12
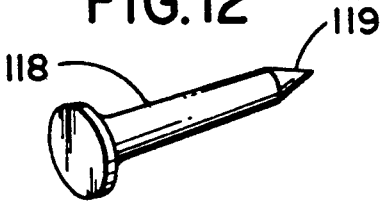
FIG. 13
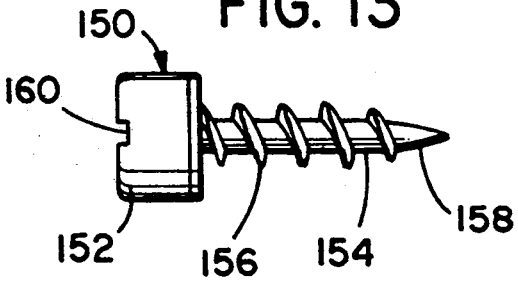
FIG. 14
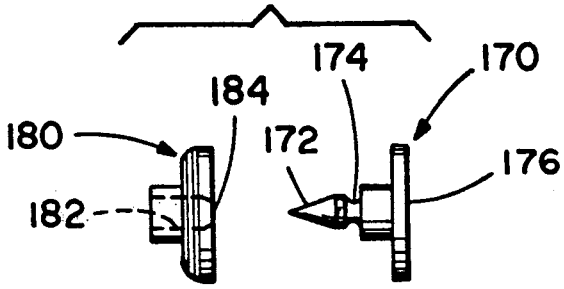

COMBINATION OF THEMATICALLY RELATED DECORATIVE OBJECTS

This is continuation-in-part of Ser. Nos. 07/554,967, 07/664,023, filed Mar. 4, 1991 and 07/664,024 filed Mar. 4, 1991 which are hereby incorporated by reference herein in their entireties.

BACKGROUND OF THE INVENTION

This invention relates to a decorative combination of objects, and more particularly to a combination of decorative objects which simulate or otherwise represent the universal image or conception of the appearance of a commonly recognized theme e.g. a ghost-like decorative object in combination with a Halloween jack-o-lantern pumpkin, or a Halloween witch in combination with a cauldron, and the like. Such decorative objects are referred to hereinafter as thematically related fanciful characters and objects.

At certain times of the year, for example at Halloween, ghost-like and pumpkin-like decorative objects are very popular, as are also witch and cauldron type decorative objects, and these objects are strongly associated with the season. Also, at a certain time of the year, for example in the fall season, in certain geographic vicinities, many leaves are on the ground and home owners often rake their leaves and dispose of the in relatively large leaf bags. Except for a relatively new type of leaf bag (the details of which are disclosed in the parent application hereto, Ser. No. 07/554,967) which has recently been sold during the Halloween season to represent or simulate a pumpkin, the known leaf bags are ordinary leaf bags with no particular significance and with no particular decorative value. In addition, except for the bag disclosed in the parent application hereto, garbage or refuse bags are typically not decorative or theme-related, and the stuffing of such bags with paper or the like for decorative purposes during holiday seasons has been unknown.

SUMMARY OF THE INVENTION

An object of the present invention is to provide a combination of thematically related decorative objects for use on a front lawn or the like which utilizes a large relatively round bag, such as a leaf-type bag, and a larger sheet-like material as an element of the thematic combination.

A further object of the present invention is to provide a simple, easy-to-manufacture, easy-to-assemble combination of decorative objects for use either indoors or outdoors, as desired.

Another object of the invention is to extend the inventions of the parent applications hereto to provide kits of thematically related decorative objects.

In accordance with the objects of the present invention, a decorative structure combining more than one structural element is provided. One element simulates a virtually universal conception of the appearance of a fanciful character or object such as a ghost, witch, fairy tale and nursery rhyme character and the like; and the other element simulates a virtually universally recognized conception of a thematically related fanciful object or character different from that of the first element. The respective elements of the combination simultaneously present to the sight of an observer a view which represents a common recognized theme such as a season, holiday, nursery rhyme, folktale, literature or media characters. Preferably, the element simulating a universal conception of the appearance of a fanciful character or object such as a ghost, witch, fairy tale and a nursery rhyme character includes: a support bag member for receiving a filling such as crumpled pieces of paper therein; a flexible sheet-like member adapted to be placed over said support bag member, and having indicia simulating an appearance of such a fanciful character thereon; and means for securing free ends of said sheet-like indicia-bearing member to a support surface after placing said sheet-like member over said support bag member. The second element is preferably in the form of a decorative bag assembly which includes: a bag having first and second opposite ends, at least the second end being open to receive a filling material therein; and a bunching means for bunching together and closing the second open end to form a bunched closed end after the filling material is inserted in the bag; the bag having a substantially rounded shape when filled with the filling material and when the second end is bunched together by the bunching means, and having indicia simulating a virtually universally recognized conception of a fanciful character or object such as a pumpkin, cauldron, bag of toys, elf, or the like which is thematically related to the first element.

In a further aspect of the invention, each structural element of the combination is separately formed and arranged in a closely adjacent or in an abutting relationship.

In another embodiment of the invention the respective elements are of distinctly different geometric configuration e.g. pyramidal or inverted conical, and generally spherical, and of substantially different size, with the pyramidal or conical element being greater in height than the spherical element.

According to a further aspect of the present invention the respective elements of the combination are secured together at abutting contiguous locations and each element is also secured to a support base which can be the ground, or a floor or platform.

According to yet another aspect of the invention, a kit is provided which includes the components for assembling and erecting the decorative combination structure of the present invention, e.g.: ghost and pumpkin; witch and cauldron; Santa Claus an elf or bag of toys; or the like.

Additional objects and advantages of the invention will become apparent to those skilled in the art upon reference to the detailed description in conjunction with the accompanying drawings.

BRIEF DESCRIPTION OF THE DRAWINGS

FIGS. 9 and 9(A) show different embodiments of the sheet-like member used in FIG. 6 in their unassembled states;

FIG. 10 shows a twist tie for use in the present invention;

FIG. 11 shows a connecting clip for use in the present invention;

FIG. 12 illustrates a peg for use in connecting the structure of the element of FIG. 5 to the ground or the like;

FIG. 13 illustrates a stake for use in place of the peg of FIG. 12;

FIG. 14 illustrates a tack and connector structure for use in place of the clip of FIG. 11 for connecting together the components of the element of FIG. 5;

DETAILED DESCRIPTION OF INVENTION

Figure 1A:
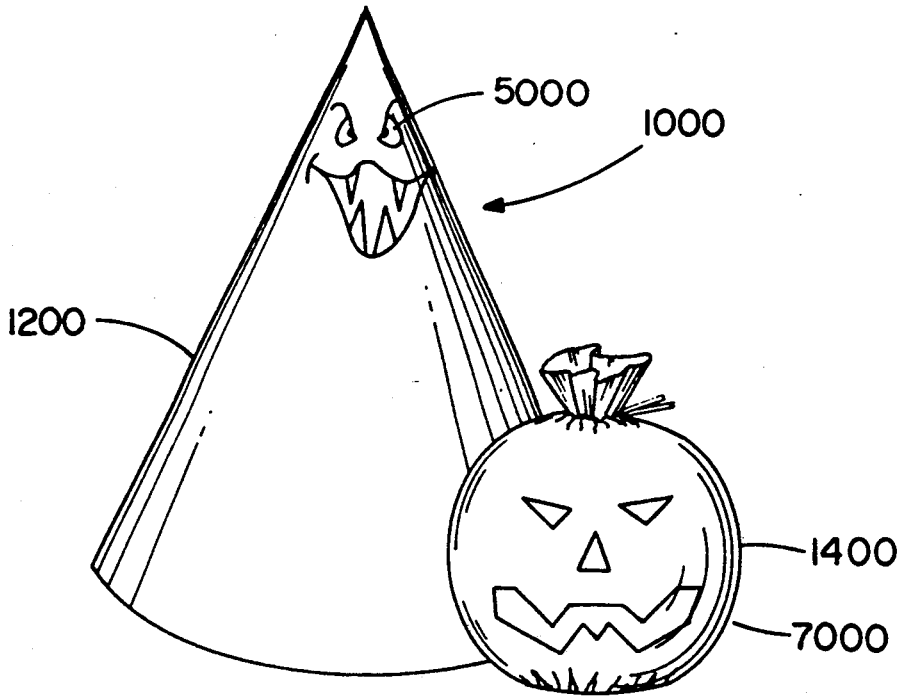
FIGS. 1(A)–1(C) show respective specific embodiments of the present invention.
Figure 1B:
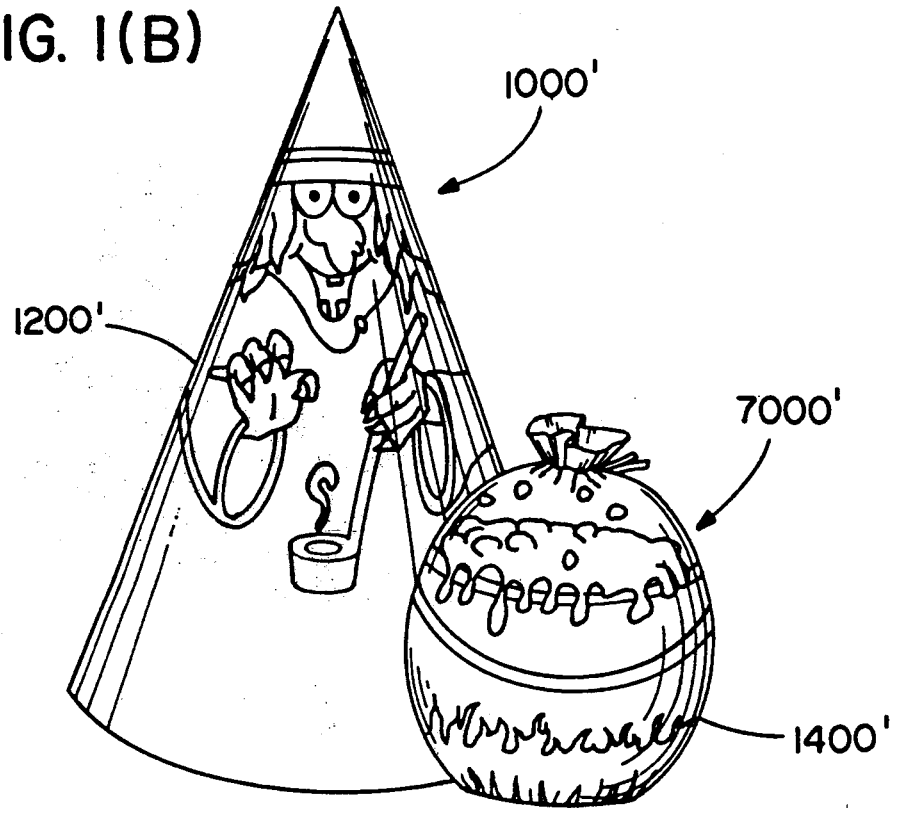
Figure 1:
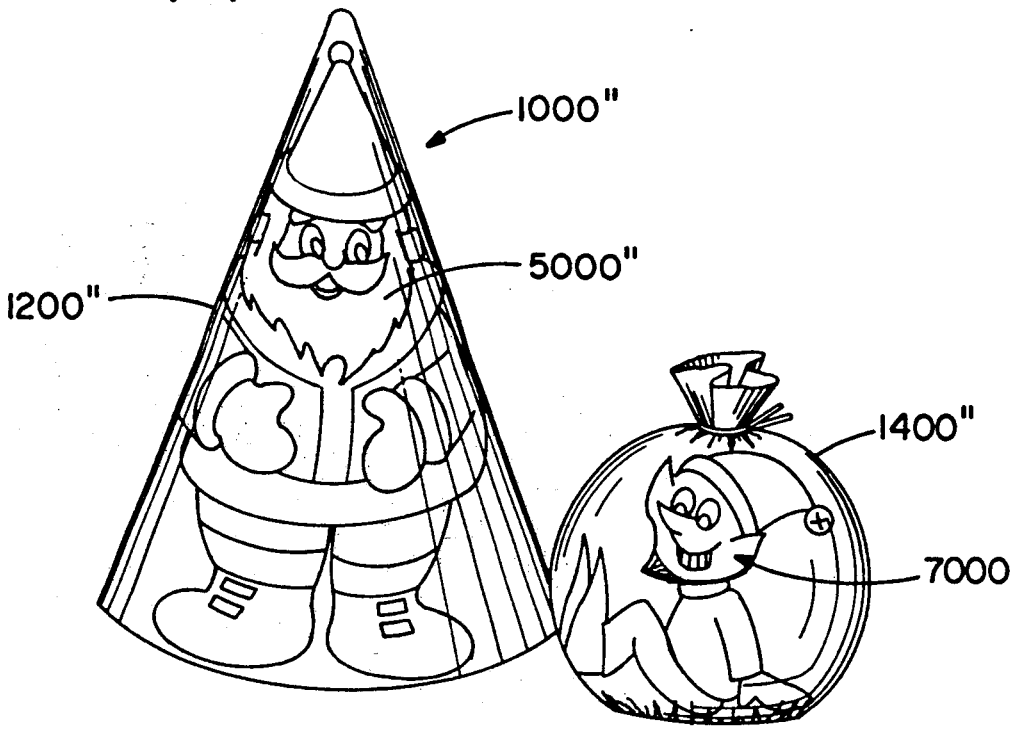

With reference to FIGS. 1(A)-(C), decorative combination structures of the present invention are indicated at 1000, 1000' and 1000" representing respectively, a Halloween ghost 1200 and pumpkin jack-o-lantern 1400, a Halloween witch 1200' and boiling cauldron 1400' and a Santa Claus 1200" and an elf 1400". Each of the foregoing decorative combination structures includes a flexible sheet-like member 2000, 2000' and 2000", shown in FIGS. 2(A)-(C) which is openable at 3000, 3000', 3000" to form a first element (1200, 1200', 1200" in FIGS. 1(A)-(C)) having an inverted generally conical shape. The periphery 4000, 4000', and 4000" can be straight sided or curvilinear to appropriately accommodate the indicia 5000, 5000', 5000" of the fanciful character or object of a first element 1200, 1200', 1200" of the decorative combination 1000, 1000', 1000". Each of the decorative combination structures of the present invention additionally includes a generally tubular bag 6000, 6000', 6000" shown in FIGS. 3(A)-(C) which, when containing filler material such as leaves, crumpled paper, or lawn debris as hereinafter described, and closed at both ends, forms a generally round, spherical second element (1400, 1400', 1400" in FIGS. 1(A)-(C)). The generally round second elements are provided with indicia 7000, 7000', 7000" which thematically relate the fanciful object or character of the second element 1400, 1400', 1400" to the fanciful object or character of the first element 5000, 5000', 5000".

Figure 2:
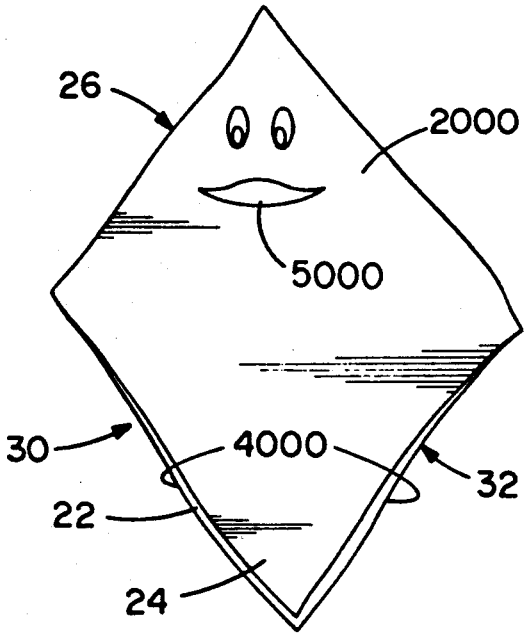
FIGS. 2(A)–2(C) show respective first elements of the embodiments of FIGS. 1(A)–1(C)
Figure 3:
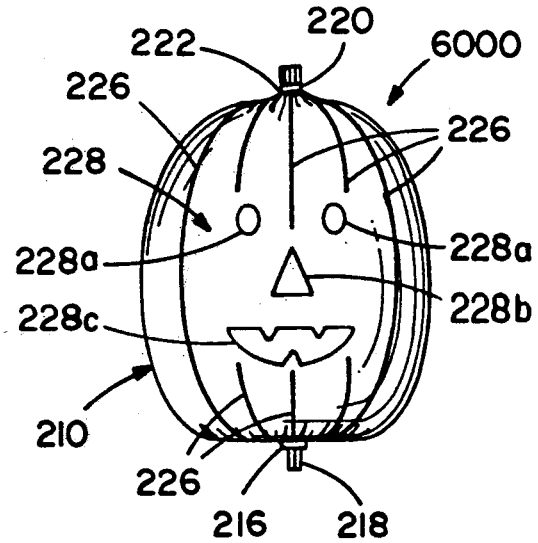
FIGS. 3(A)–3(C) show respective second elements of the embodiments of FIGS. 1(A)–3(C)
Figure 3B:
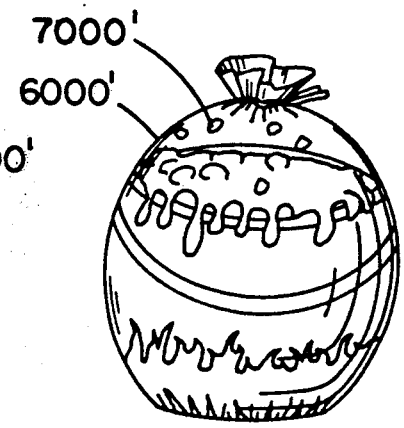
Figure 3C:
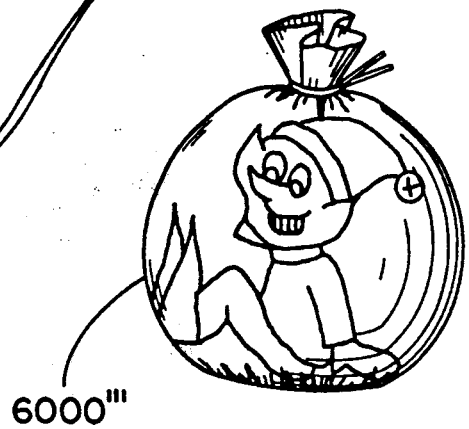
Figure 4:
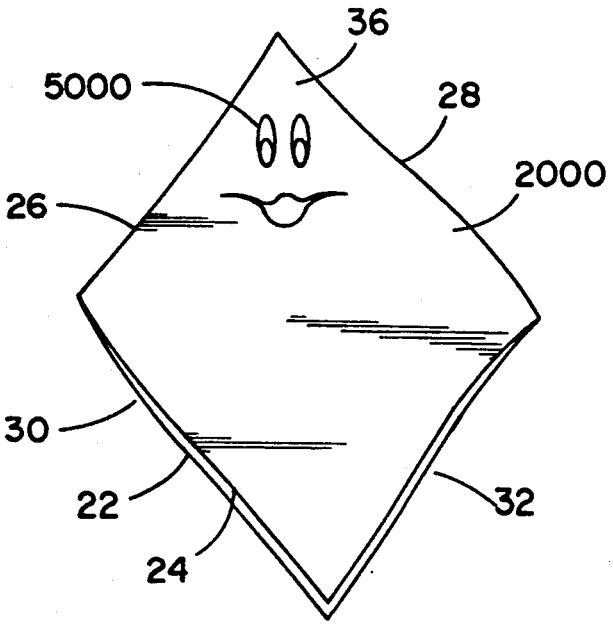
FIG. 4 shows a flexible sheet-like member having a "ghost-like face" imprinted thereon and forming part of the structure of a ghost-like decorative object.

FIG. 4 shows a sheet-like member 2000 as shown in FIG. 2(A) for forming a first structural element with ghost-like indicia 5000 (although other indicia of a fanciful character or object could be used) which comprises two sheet-like portions 22, 24 (front and rear) which are connected together along edges 26, 28, and which are opened along edge portions 30, 32, as shown in FIG. 4. The sheet-like portions are preferably thin, flexible plastic material of the type generally used for plastic bags such as leaf or garbage bags. However, a fabric member may also be used. One or both of the sheet portions 22, 24 has the facial indicia 5000 thereon which represents or simulates a ghost-like object; i.e., what one thinks a ghost looks like or should look like. The facial indicia on sheet portion 24 are shown in FIG. 4, but it should be clear that similar (or different) facial indicia can also be located on the opposite side (facing into the page of sheet portion 22), if desired.

Figure 2B:
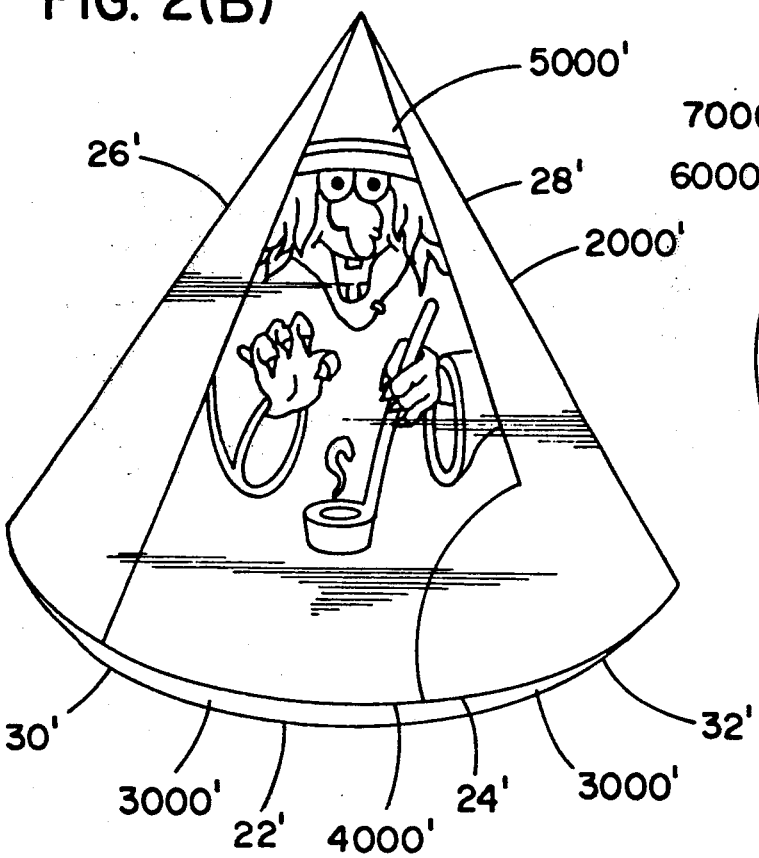

The sheet-like member 2000 in FIG. 4 is shown as two sheet portions connected together at edges 26 and 28. The interconnection between the sheet portions may be by means of heat sealing or the like. One of the connections 26, 28 may merely be a fold line of a single elongated sheet, and after the sheet is folded along the fold line (for example at fold line 28 in FIG. 4), the other interconnection (for example 26) is made by heat sealing. The upper corner portion 36 is shown as pointed due to the folding and sealing of member 20. It could, however, be rounded or any other shape which could be imparted by heat sealing and tearing off of the excess corner material at the seal. Also, the edge portions can be curved as shown at 30', 32' in FIG. 2(B) to accommodate particular indicia 5000' as shown in FIG. 2(B).

While decorative facial indicia are shown as being already applied to the sheet-like member 2000 and 50 of FIGS. 2(A)-(C) and 4, the facial indicia could be applied by the user. In such a case, a stick-on set of indicia could be provided in a kit, and the user could adhere the same to the sheet-like member, as desired, to create personalized ghost-like members. Alternatively, the indicia can be drawn on by hand, using a marker pen, paint, or the like.

Figure 5:
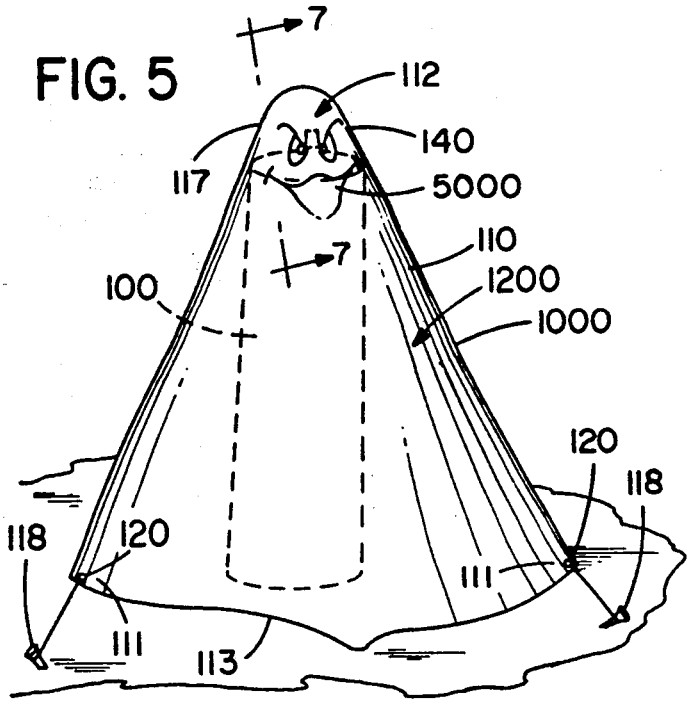
FIG. 5 is a perspective view showing an embodiment of an element of the combination of the present invention utilizing the sheet-like member of FIG. 4.

FIG. 5 shows the assembly and installation of a first element 1200, 1200', 1200" in FIGS. 1(A)-(C) for the decorative structural combination of the invention. The arrangement shown is adapted to be used in a fixed position, for example on the lawn or outside area of a house of a user and to be combined with a second element as herein described. The ghost-like or other fanciful structure shown in FIG. 5 comprises a support member 100 which may take the shape of a bag-like structure which is filled with leaves, crumpled newspaper, or waste materials, such as lawn debris, as desired. The bag 100 is shown as an elongated tubular shaped bag in FIG. 5. It could take other shapes, such as rounded, but an upright tubular bag as shown in FIG. 5 is preferred. After filling of the elongated tubular bag member 100, the bag 100 is tied closed at the top (i.e. by a "tie") and is covered by a flexible sheet-like member 110 which is draped thereover, as will be described in more detail hereinafter with reference to FIGS. 5 and 6.

Figure 2C:
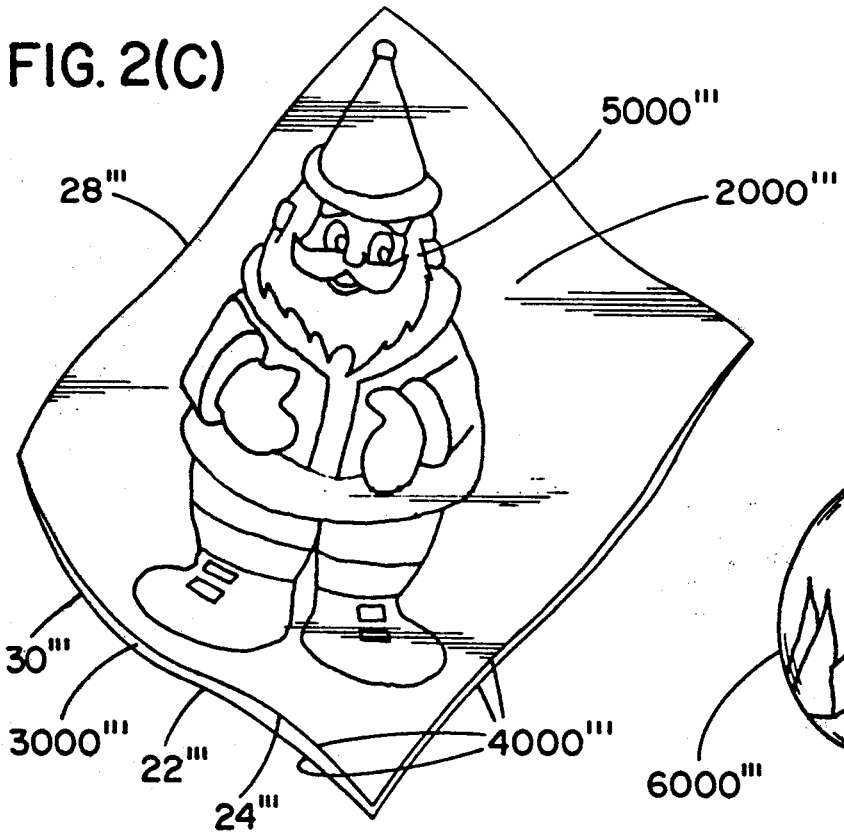

As shown in FIG. 5, the sheet-like member 110, in the case of the ghost-like element, is preferably white to simulate the appearance of a ghost, and preferably has indicia 112 thereon which represent a fanciful or simulated appearance of the face of a ghost-like object. For other fanciful indicia, the sheet-like member 110', 110'' can be multicolored as shown in FIGS. 2(B) and 2(C) to accommodate the particular fanciful representation of the indicia. The free lower ends of the sheet-like member 110 are spread to form a generally pyramidal or inverted conical shape and are secured to the ground by means of for example, twist ties and peg-like members, as will be described in greater detail hereinbelow.

Figure 6:
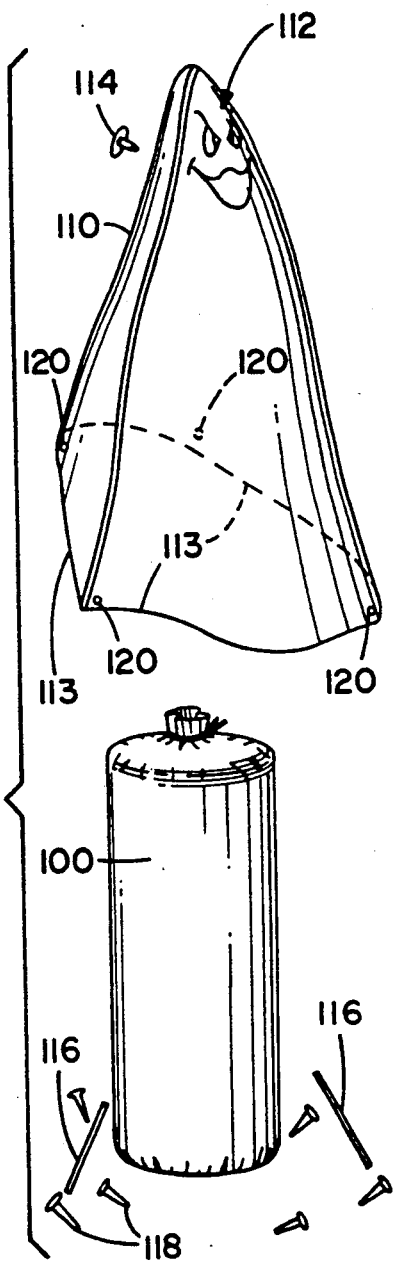
FIG. 6 is an exploded view showing the components of the element of FIG. 5 in separated form.

Referring to FIG. 6, the various components of the element of FIG. 5 are shown in their disassembled state. The basic components comprise the filled tubular bag 100, which is provided to the user in a flat unfilled state (see FIG. 9), the sheet-like member 110, spread clips 114, twist ties 116 and pegs 118. The sheet-like member 110 preferably has holes 120 therein at various spaced apart positions around the lower peripheral portions thereof for use in connecting twist ties thereto for anchoring the lower edge portions of the sheet-like member 110 to the ground. The anchoring technique will be described in detail hereinbelow.

Figure 7A:
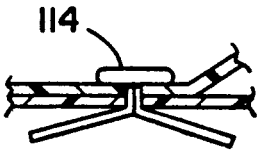
FIGS. 7, 7(A), 7(B) show details of the components of FIG. 6.
Figure 7B:
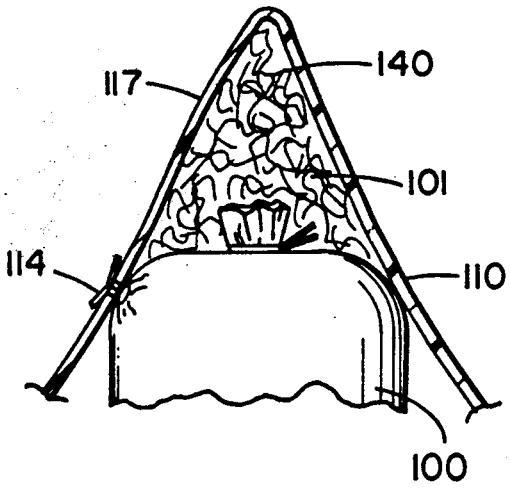
Figure 7:
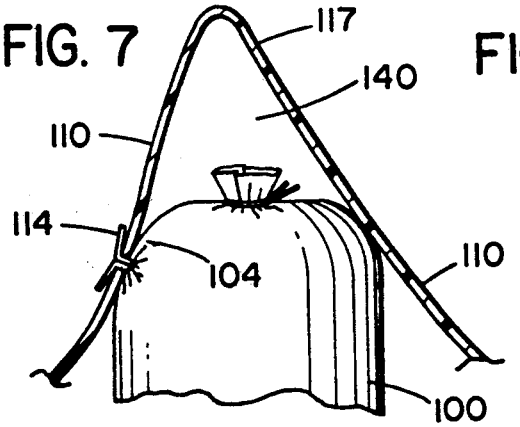

FIG. 7 shows a detail taken along section line 7—7 in FIG. 5, showing how the sheet-like member is suitably secured at at least one portion thereof to an upper portion of the filled bag 100 by means of a spread clip 114. The clip 114, which is shown in more detail in FIG. 11, is preferably a readily available spread clip which is used in offices and which is widely available in stationary and office supply stores. As seen in FIGS. 7 and 7(A), the clip, in its closed state as shown in FIG. 11, is pierced through the outer sheet-like member 110 and an upper portion 109 of the bag 100. Then the free ends of the clip are spread outwardly, as shown in FIGS. 7 and 7(A), to secure the sheet-like member 110 and filled bag together. More than one clip may be used at spaced apart portions around the periphery of the upper portion of the bag 100, one clip being shown in FIG. 7 by way of example.

Figure 8A:
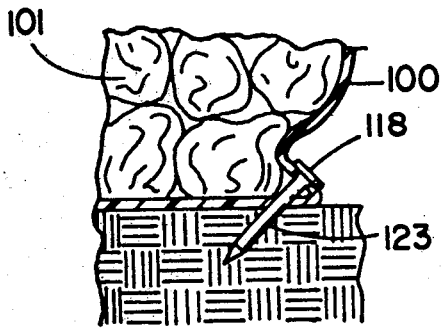
FIGS. 8(A) and 8(B) show details of different means for securing the embodiment of FIG. 5 to the ground.
Figure 8B:
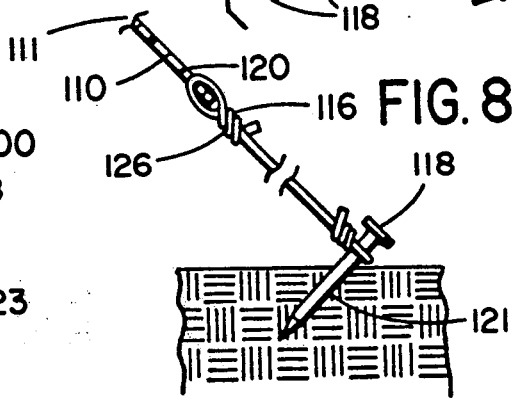

As shown in FIG. 8(B), after the sheet-like member 110 is secured to the upper portion 109 of the bag 100, the lower free ends or "shirt-tails" 111 of the outer sheet-like member 110 are secured to the ground at spaced apart portions around the periphery 113 thereof, with the outer sheet-like member 110 being preferably in the form of an inverted conical shape, as shown in FIG. 5. FIG. 8(B) shows a twist tie 116 which passes through a hole 120 in the lower portion of the sheet-like member 110, and which has an end wrapped around itself at 126 to secure itself to the lower portion of the sheet-like member 110. The opposite end of the tie 116 is wrapped around or otherwise connected to a peg 118, as shown for example in FIG. 8(B). The peg 118 is pushed into the ground, as shown at 121 in FIG. 8(B). This interconnection to the ground is shown schematically in FIG. 5 at spaced apart portions around the periphery 113 of the lower edge of the sheet-like member 110. By anchoring the sheet-like member 110 to the ground as shown, (as well as by connecting the sheet-like member to the filled bag 100) sufficient support is provided to keep the ghost-like member from toppling over, while also allowing the sheet to "flutter" in the wind, creating an eerie, ghost-like effect. Instead of using ties 116, the free ends of the sheet-like member may be directly pegged to the ground, but the technique of using the tie between the sheet and the peg is preferable. String, wire or the like can be used in place of the ties 116.

Where a fluttering effect is not consistent with the provided indicia, such as in the case of witch 5000' of FIG. 2(B), a substantially increased number of interconnections with the ground are preferably provided to establish a more firm structure.

In order to further anchor the structure to the ground, pegs 118 are pierced through the lower portions of the bag 100 at spaced apart portions around the periphery of the lower portion of the bag 100, anchoring the bag per se to the ground, as shown at 123 in FIG. 8(A). This further improves the structural integrity of the resulting structure.

As shown in FIG. 7, the upper portion 117 of sheet-like member 110, extends above the upper portion 109 of the support bag 100 so as to provide a free hollow space 140 therebetween. This free hollow space 140, when empty, provides room for the upper portion of the sheet-like member 110 to "flutter" and to be movable so as to further simulate the eerie appearance of a ghost when desired. However, when filled, e.g. with crumpled paper 101, as shown in FIG. 7(B), the upper portion 117 of the sheet-like member 110 will stiffen to accommodate the witch indicia shown at 5000' in FIG. 2(B).

The support bag 100 may be filled with leaves or crumpled newspapers, or any other waste materials or other non-waste materials suitable for filling a garbage-type or leaf-type bag. FIG. 8(A) shows the filling material 101 as large particles, for example, crumpled newspapers. It should be clear that any type of filling material can be used. Crumpled newspapers or leaves, however, are desirable since they are usually readily available and, in the case of leaves, in want of being disposed. Further, crumpled n :wspapers or leaves provide a relatively large amount of filling with a relatively large amount of air space between the particles thereof, thus not overly increasing the weight of the resulting structure.

Figure 9A:
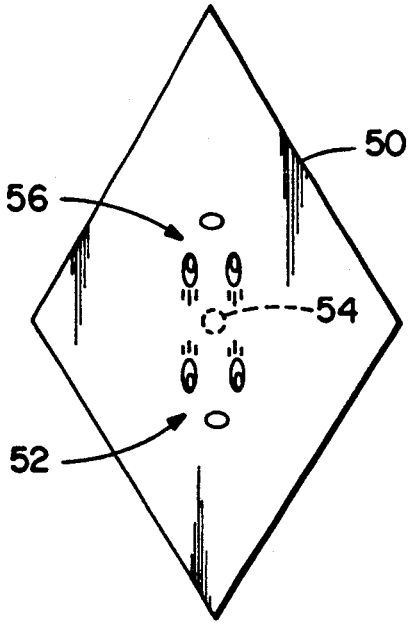

The sheet like member 110 may be a member folded over and sealed at one edge, as shown in FIG. 9. In FIG. 9, the upper edge 130 of the outer sheet-like member is folded over, and the left-side edge is heat sealed together. The edge portions 134, 136 are opened for passing over the supporting bag 100. Alternatively, a single unfolded sheet-like member, such as the sheet member 50, shown, in FIG. 9(A), may be used to be draped over the bag 100. The sheet member 50, of course, must be suitably sized to fit over bag 100 with suitable draping and with sufficient material to permit extending same into a generally inverted conical shape as shown in FIG. 5 so as to permit fluttering, if desired, or firmness as in FIG. 7(A), and to create a more realistic representation of a selected fanciful character. In FIG. 9, the supporting bag 100 is shown in its flat, folded state, before filling thereof.

FIG. 10 shows a generally well-known twist tie which has a plastic or paper-like wide portion 115 (which is flexible) and a wire member 117 embedded therein or connected thereto, to permit positive tying, twisting or the like of the tie member 116. The peg 118 of FIG. 12 may be any type of peg with a pointed end 119 which can easily pierce the ground, and may, for example, be a golf tee, which is readiiy available.

FIG. 13 illustrates a screw-threaded-type stake member 150 which can replace the peg or tee 118 of FIG. 12 for securing the apparatus to the ground. The member 150 has a head portion 152 and a shaft or shank portion 154 with threads (similar to screw threads 156) thereon. The shank portion 154 is provided with a generally pointed end 158 for ease of insertion into the ground or the like. In use, the user pierces the plastic bag material with pointed end 158 and applies pressure on the head 152 so that the pointed end 158 begins to penetrate the ground or the like. Then, the head 152 is either pressed straight into the ground (if it is soft enough) or it is turned by hand, or a coin or the like is inserted into the coin or screw driver slot 160 to turn the stake 150, to "screw" it into the ground or the like. The stake 150 can be molded from plastic material (i.e. polypropylene) by injection molding or may be otherwise formed.

FIG. 14 shows a tack structure which can replace the spread clip 114 shown in FIG. 11. The tack structure of FIG. 14 comprises a push-tack 170 having a pointed shank member 172 with a recess 174 therein. A receptacle 180 is provided which has an elongated opening 182 therein with a reduced cross-sectional opening portion 184 at the front end thereof. In use, the plastic parts to be tacked together or clipped together are held by the user, the tack member 170 is pushed therethrough beginning with the pointed end 172 by applying pressure to the head end 176, and the receptacle member 180 is placed behind the tack and the pointed end 172 of tack member 170 is pushed into the opening 182 of the receptacle member and the reduced diameter portion 184 "snaps" into the reduced diameter section of shank 172 to "snappingly lock" thereon, and to hold the clipped plastic parts together. The snap action engagement is obtained by virtue of the resiliency of the plastic material from which the receptacle 180 are made, for example polypropylene or other suitable injection moldable plastic material.

Various other devices can be used in place of the stake of FIG. 13 and the tack structure of FIG. 14, as desired.

Figure 15:
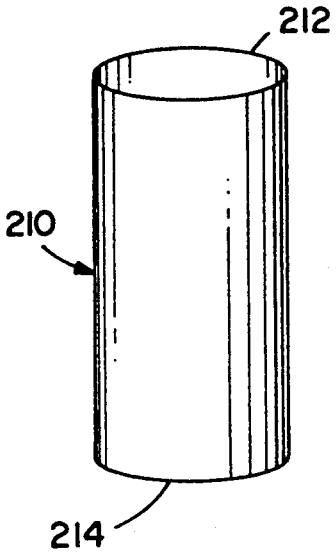
FIG. 15 is a perspective view of a tubular bag that can be used to form a decorative bag element for use according to one combination of the present invention, and which is shaded to have an orange color, it being clear that other colors could be used, depending upon the object being simulated.
Figure 16A:
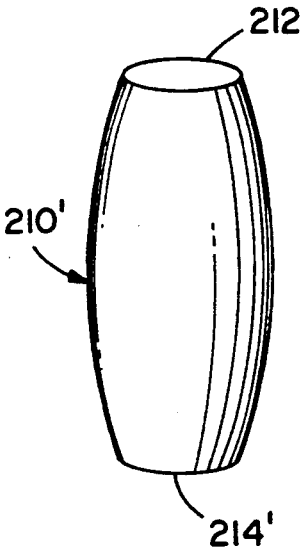
FIGS. 16(A)-16(D) are perspective views of other types of bags that can be used to from a decorative bag assembly according to the present invention.
Figure 16B:
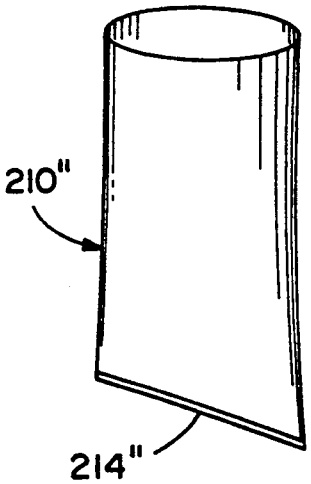
Figure 16C:
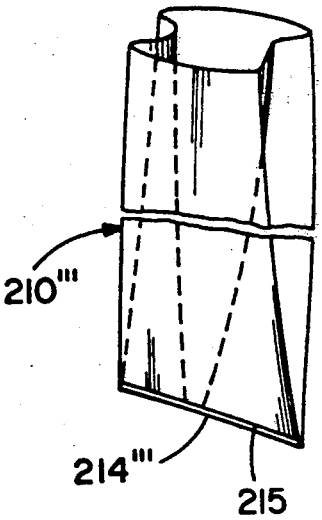

FIG. 15 shows a flexible bag 210 for forming a second structural element thematically related to the aforedescribed first element and represents a fanciful object or character as above-described. Bag 210 according to one aspect of the present invention is formed in a substantially cylindrical shape to form a flexible, stretchable plastic material; for example, of the type conventionally used for trash or leaf bags. Alternatively, the bag material can be any other type of plastic film-type material, paper woven or non-woven fabric or any other suitable thin, flexible, film-type material. As shown by the shading thereon, the outer surface of the bag 210 is shaded to have an orange color suitable for jack-o-lantern pumpkin indicia (indicated at 7000 in FIG. 1(A). Any suitable color appropriate to a particular indicia can be used, as will be appreciated from the description which follows. Although bag 210 is shown having a cylindrical configuration, the bag may have any other suitable configuration within the scope of the present invention, such as the convex cylindrical configuration shown by bag 210' in FIG. 16(A) or the conventionally shaped leaf or trash bag 210" having a linearly closed bottom end 214', as shown in FIG. 16(B). As a still further alternative, a conventional gussetted bag 210"' can be used having a closed bottom end 214", as shown in FIG. 16(C). With the gussetted bag 210"', the opposed sides of the bag are each drawn inwardly into the bag and secured to the overlapping bottom portion to form gussets, as shown at 215 in FIG. 16(C) as is conventional. In any case, bag 210 has an upper open end 212 and a lower end 214 which may be open as shown in FIGS. 15 and 16(A) or which may be closed as shown in FIGS. 16(B) and 16(C).

Figure 17A:
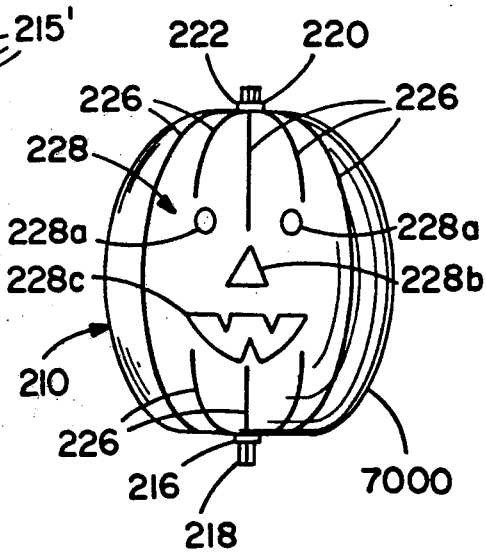
FIGS. 17(A)-17(C) are front elevational views of a decorative bag element formed from a bag of FIGS. 15, 16(A), 16(B), 16(C), or 16(D) and arranged respectively as a pumpkin, a cauldron, and an elf.
Figure 17B:
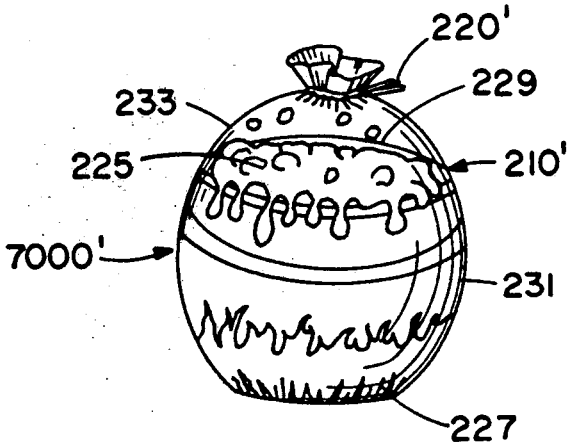
Figure 17C:
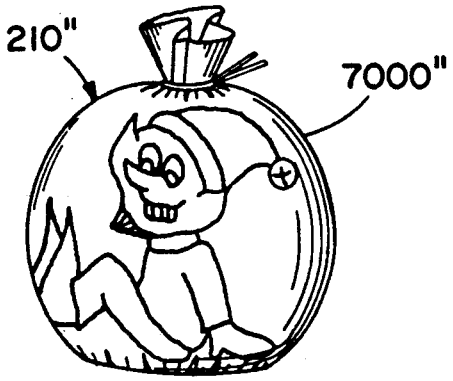

In accordance with one aspect of the present invention, bag 210, when assembled and filled assumes a substantially rounded configuration, as shown in FIGS. 17(A)-(C). This is accomplished as follows. First, open end 214 of bag 210 of FIG. 15 unless already sealed, is closed in a "bunched" manner by any suitable first closure means, such as a wire or plastic tie 216 conventionally used with trash bags, so as to form a first tied-together or bunched closed end 218. Other closure means such as a clamp, rubber band or the like can be used in place of tie 216. Thereafter, bag 210 is filled with trash material, such as leaves, crumpled newspapers, garbage or other lightweight materials, such that bag 210 assumes an almost rounded, generally spherical shape. Then, the upper open end 212 of bag 210 is closed in a "bunched" manner by means of second closure means, such as a tie 220, or a clamp, or a rubber band, or the like, so as to form a second tied-together or bunched closed end 222. As a result, the rounded configuration of FIGS. 17(A)-17(C) is achieved.

In the case of bag 210 of FIGS. 15 and 17(A), and as mentioned above, the bag has an orange color at least on the outer surface thereof, as indicated by the shading in FIG. 15. Such color-shading has been omitted from FIG. 17(A) for the sake of clarity. Accordingly, filled bag 210 (when orange) assumes the rounded shape of a pumpkin in which upper closed end 222 of FIG. 17(A) simulates the stem of the pumpkin.

To further simulate the appearance of a pumpkin, vertical black (or other dark color) stripes 226 can be printed on the outer surface of bag 210. Further, ornamentation or decoration, for example, in the form of facial indicia 228, can be provided separately or printed on the bag. For example, eyes 228*a*, nose 228*b* and mouth 228*c* can be separately provided to be applied by means of adhesive on the outer surface of bag 210. In such case, mouths having different expressions, such as a frown, smile or the like, can be provided for selective use by the user. Preferably, the facial indicia are "self-stick" adhesive backed members for easy application. Alternatively, such facial indicia 228 can be pre-printed on the outer surface of bag 210. The simulated pumpkin, 7000 is a thematically related object for combination with a ghost-like element 1200 as shown in FIG. 1(A) and hereinafter described. Other decoration can be provided in place of or in addition to the above-described facial indicia. For example, in FIG. 17(B), a witch's boiling cauldron 7000 is represented as a thematically related object for combination with a Halloween witch 1200' as shown in FIG. 1(B) and as hereinafter described. In FIG. 17(B) the cauldron 7000' is shown to be heated at its bottom by flames 227 and to have a boiling froth at its open top 229 with peripheral decorative borders at 231 and 233.

FIG. 17(C) shows a seated elf representing a Santa's helper. As shown in FIG. 17(C), the bag 210" is generally flat on the bottom, although the overall appearance of the bag is substantially round.

Similar effects as described above are obtained when using the bags 10" and 10"' of FIGS. 16(B) and 16(C). In these cases, since the bottom 214' is initially closed, where desired the first step is to bunch the bottom end together and the same using a tie 216, clamp, rubber band, or the like, so that the bottom end looks "bunched" substantially the same as in FIG. 17(A). Subsequent steps are the same as above.

Thus, if a large bag is used, the resulting substantially rounded filled bag which appears as a pumpkin, cauldron, elf, or the like, and assembled in combination, respectively, with an element representing a ghost, witch, Santa Claus, or the like, in accordance with the present invention, can be placed on the lawn of a house for decorative purposes. Similar or smaller elements in combination, assembled according to the present invention, could be placed inside of the house. When the Halloween or other theme season has passed, the filled decorative bags can merely be placed near the curb of the house for trash pick-up, or stored for reuse. Even at the curb, they serve a decorative function and will attract the attention of passersby, thereby serving the desired function. Large outdoor-type bags are preferred at the Halloween season, and are preferably at least 36 inches high and preferably about 60 inches high before filling, are are preferably about 56 inches wide before filling. Other dimensions can be used, but the large sizes mentioned above are preferred since they have a high degree of visual impact on an observer, and provide an attractive appearance while also having a large filling capacity.

Figure 24:
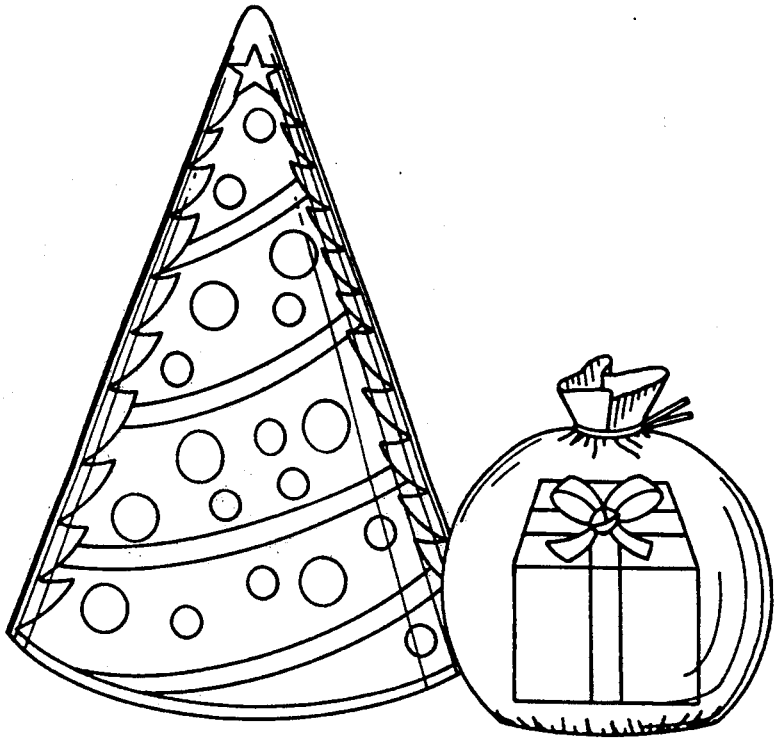
FIGS. 24(A) and 24(B) show additional combinations of thematically related decorative objects within the scope of the present invention.
Figure 24:
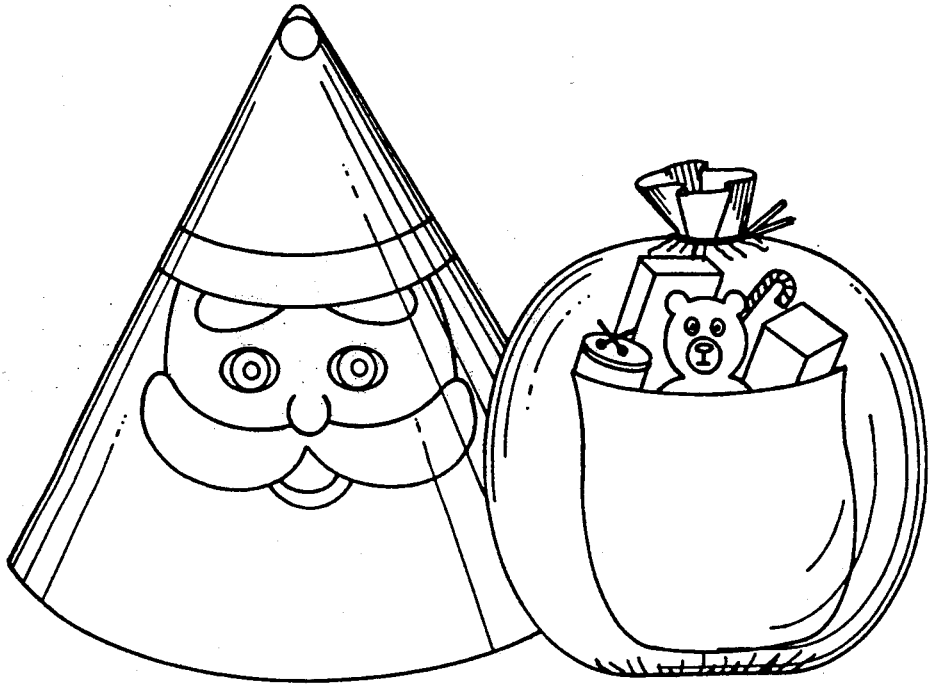

It will be appreciated that while rounded, generally spherical elements of the combination of the present invention have been described above with respect to the formation of a pumpkin, cauldron, and elf, other suitable thematic decorations can be provided. For example, and not by way of limitation, the generally pyramidal first element and generally rounded second element could represent a Christmas tree and bag of gifts as shown in FIG. 24(A), Santa Claus and bag of gifts as shown in FIG. 24(B), or some other desired thematically related combination.

Figure 18:
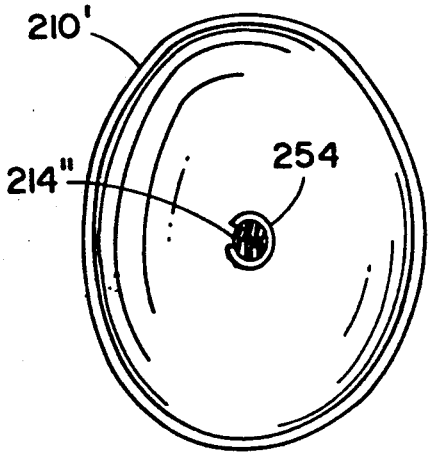
FIG. 18 is a bottom plan view illustrating a C-clip used to bunch the bottom end of a bag.

With the bags of FIGS. 15 and 16(A) having an open bottom end 214, it is generally necessary to provide sealing means at the bottom end to close the same and prevent the escape of filler material therefrom. Accordingly, it is practical to use ties such as those shown in FIG. 10 to provide a closure at bottom end 214. However, with bags 210" and 210''' of FIGS. 10 (B)-(C) having closed bottom ends 214' and 214", respectively, the bottom ends can be bunched in a less secure manner. For example, bottom ends 214' and 214" can be bunched together with a springy (i.e. made of spring metal or plastic) or bendable (i.e. metal) C-clip 254, such as shown by the bottom plan view of FIG. 18.

Figure 19:
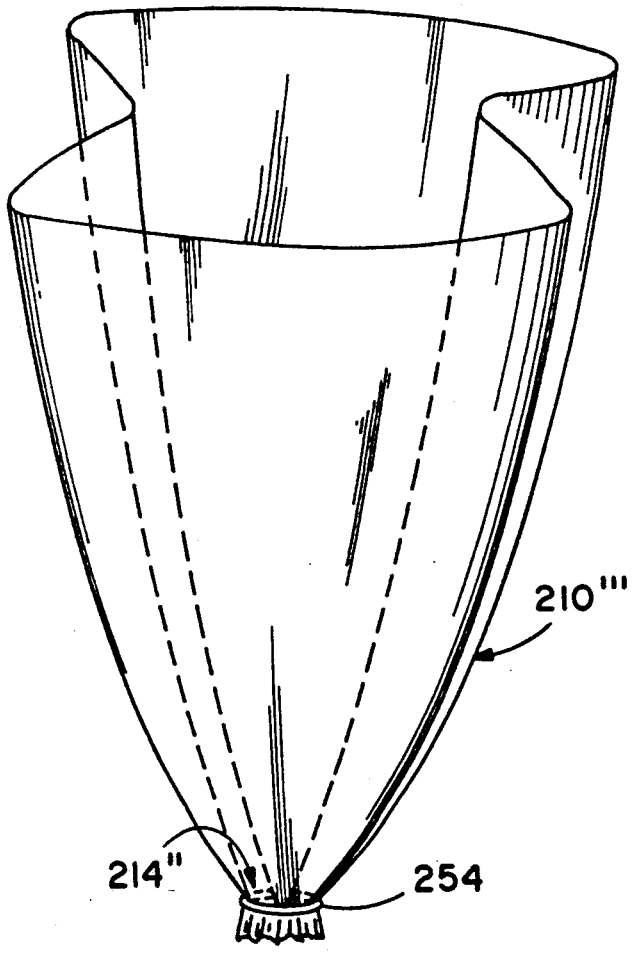
FIG. 19 shows the use of another type of C-clip used to bunch the bottom end of a gussetted bag.

As another alternative, when using the gussetted bag 10''' of FIG. 16(C), a springy or bendable C-clip 254 can be used, as shown in FIG. 19. In such case, the opposite ends of C-clip 254 enter the side gussets of bag 210''' and pull the gussets toward each other so as to effectively bunch together bottom end 214" of bag 210'''.

Figure 16D:
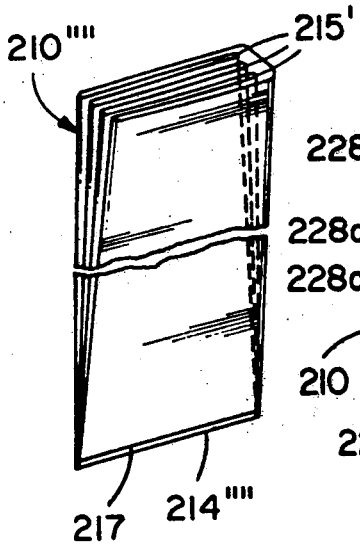

Alternatively, as shown in FIG. 16(D), when using a bag 210'''' having a closed bottom end 214''' with a so-called Z-lock, construction of the lower portion of the bag provides a limited bunching effect of the bottom end of the bag when it is filled, thereby forming a "bunching means" within the scope of the present invention. A "Z-lock" bag is a commercially available bag and can be considered as a modified gussetted bag.

Specifically, with a Z-lock bag, as shown in FIG. 16(D), gussets 215' are formed along the length of the Z-lock bag, preferably with the innermost portions of the side gussets 215' meeting around the middle of the bag. Then, the bag is folded in half over itself, and secured in such position by heat sealing or the like at the bottom 214''' of the bag. The securement of the bag in such a position can be made by a conventional heat seal 217 or the like along the bottom of the bag. In this sense, bottom end 214''' of bag 210'''' is provided with a limited bunching effect. Of course, a tie, C-clip or other bunching means can be provided for bunching bottom end 214''' of the Z-lock bag to a further extent, in the manner described with respect to the above-identified bags 210, 210' and 210".

It will be appreciated that any suitable dimensions can be used with bags 210, 210', 210", 210''' and 210''''. However, in a typical embodiment to simulate a pumpkin, cauldron, elf, or the like, it is preferred that all of the bags be made of polyethylene or a similar material having a thickness in the preferred range of about ¾ to 2 mils, with a preferred thickness of about 1.3 mils. It is also preferred that the bags have a height of about 60 inches, and a diameter of 56 inches at their greatest girth. With the gussetted bag 10''' of FIG. 16(C), it is preferred that the lower end 214''' have a length of 28 inches, while the widest portion of bag 210''' has the aforementioned diameter of 56 inches. With the Z-lock bag 210''', it is preferred that lower end 214''' have a length of 14 inches, that is, one-half of the length of gussetted bag 210'''.

The generally pyramidal or inverted conical elements 110 of the combination of the present invention are preferably made of the same materials as the bags 210, 210' . . . , and have an apex to peripheral edge length of about 72 inches so that when assembled, the generally pyramidal or inverted conical element is about twice as tall as the rounded element.

Figure 20A:
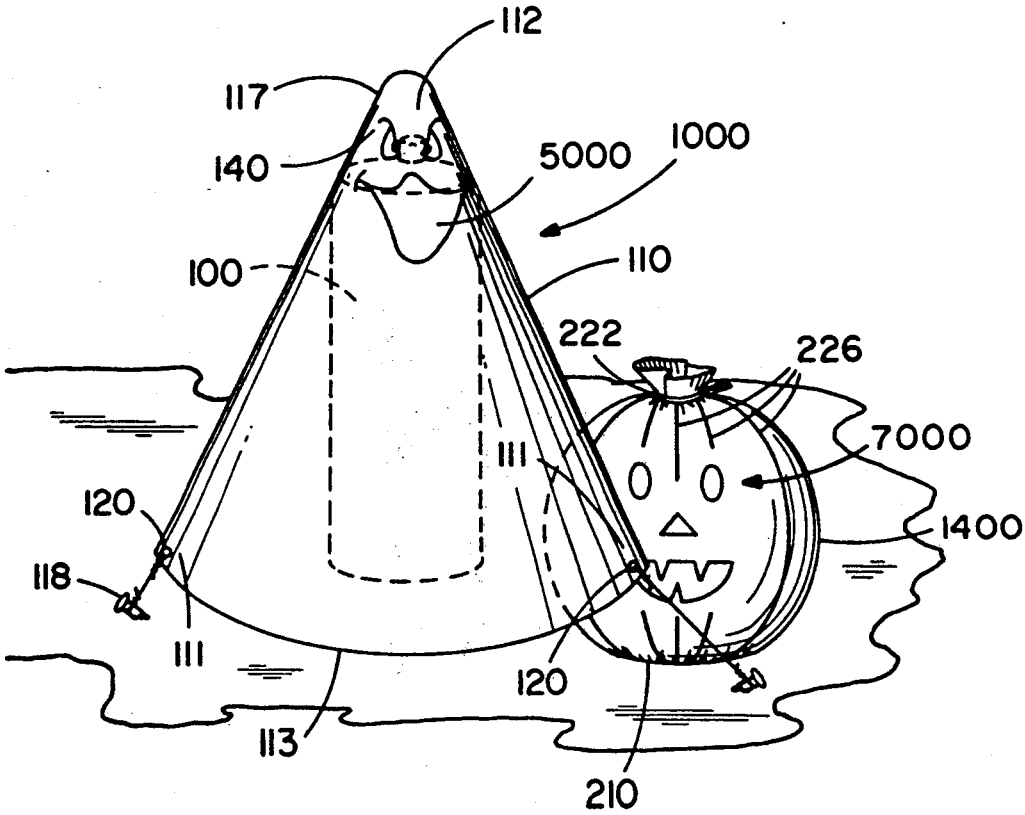
FIG. 20(A)-20(C), 21(A) and 21(B), and 22(A) and 22(B) illustrate the assembly of a combination of elements for respective embodiments of the present invention.
Figure 20C:
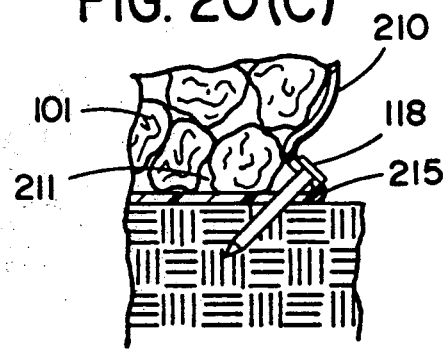
Figure 20B:
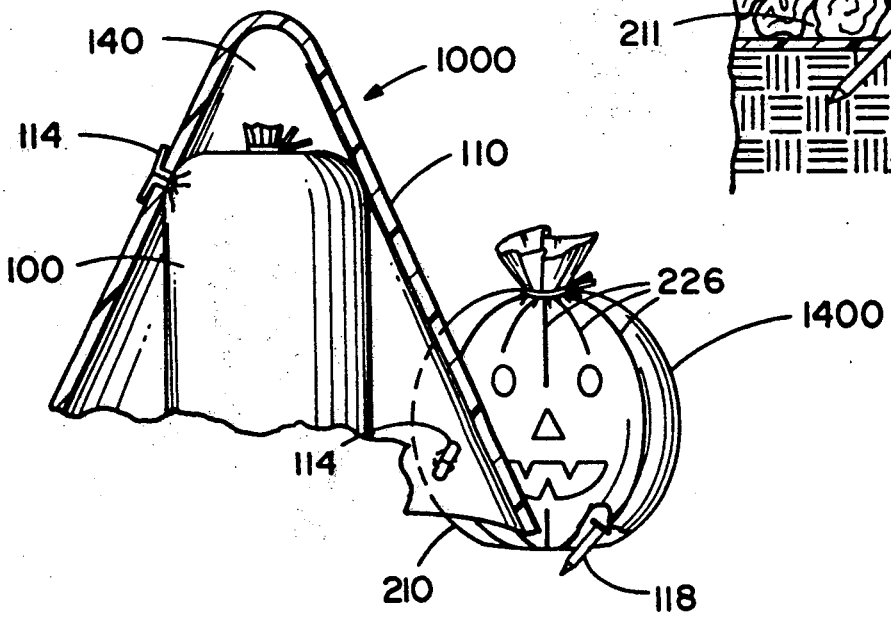
Figure 21A:
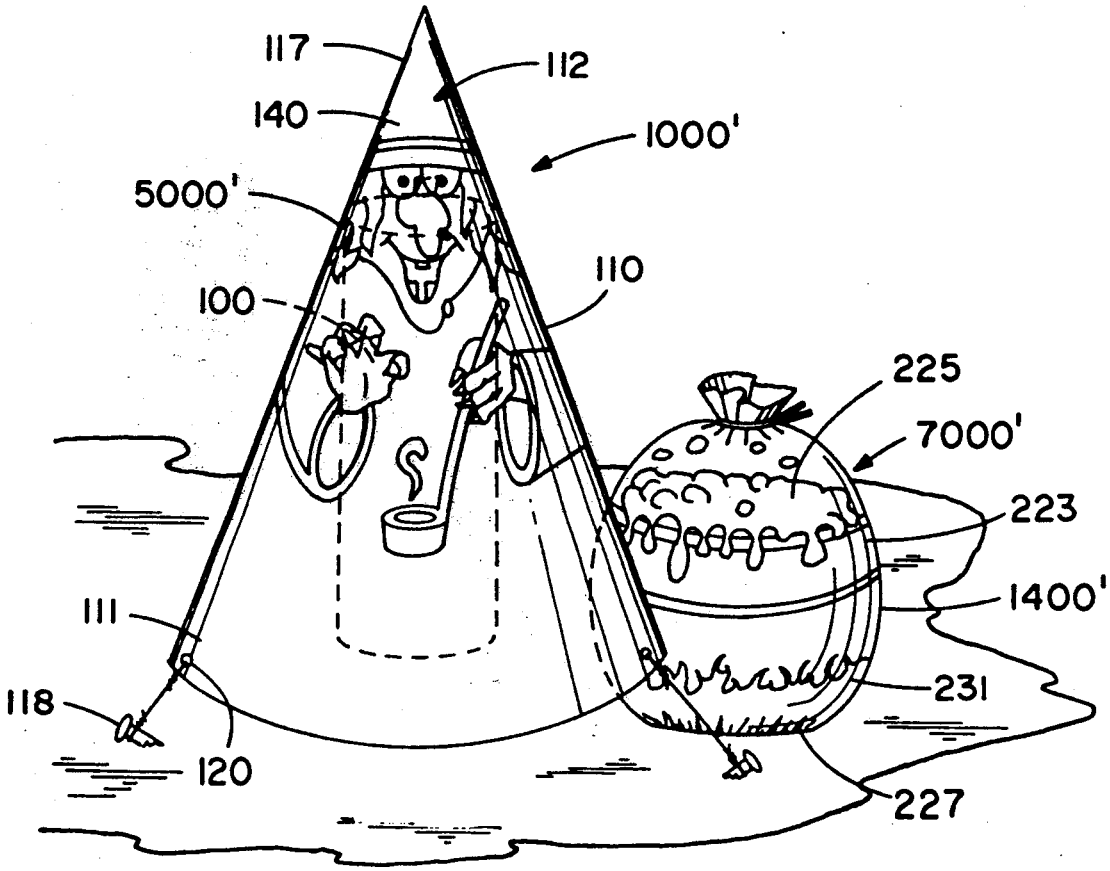
Figure 21:
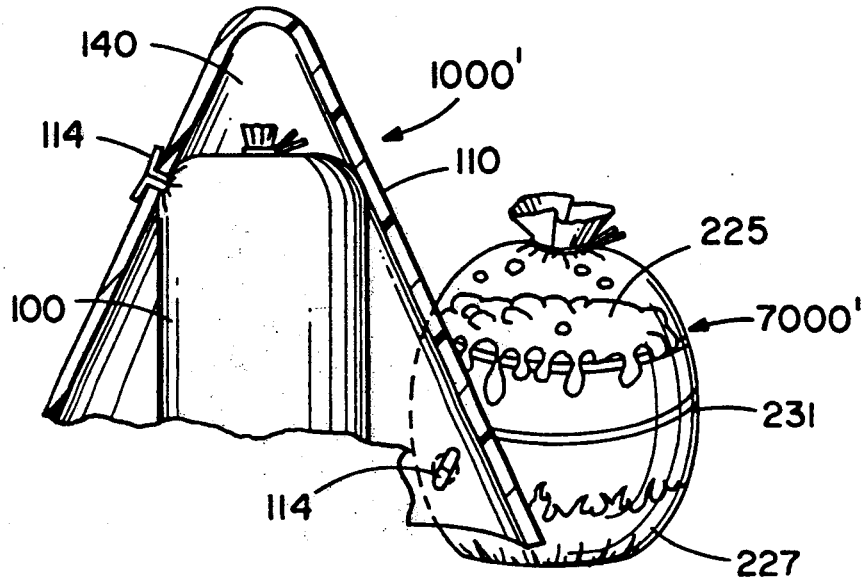
Figure 22A:
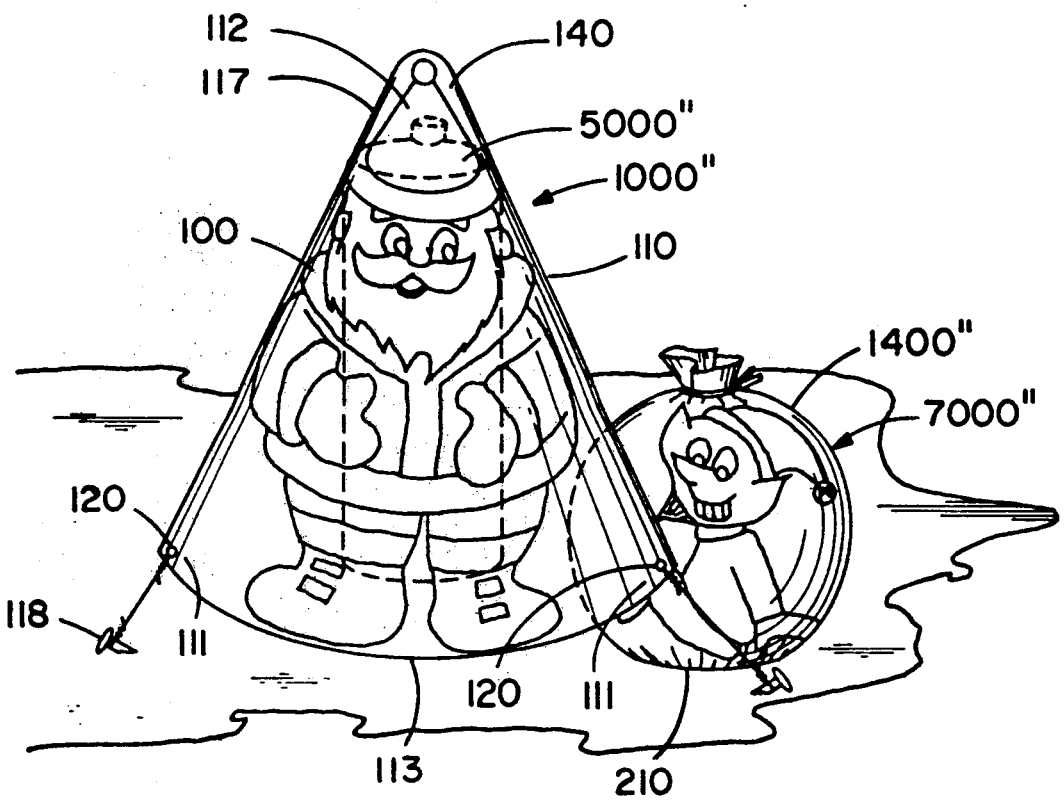
Figure 22B:
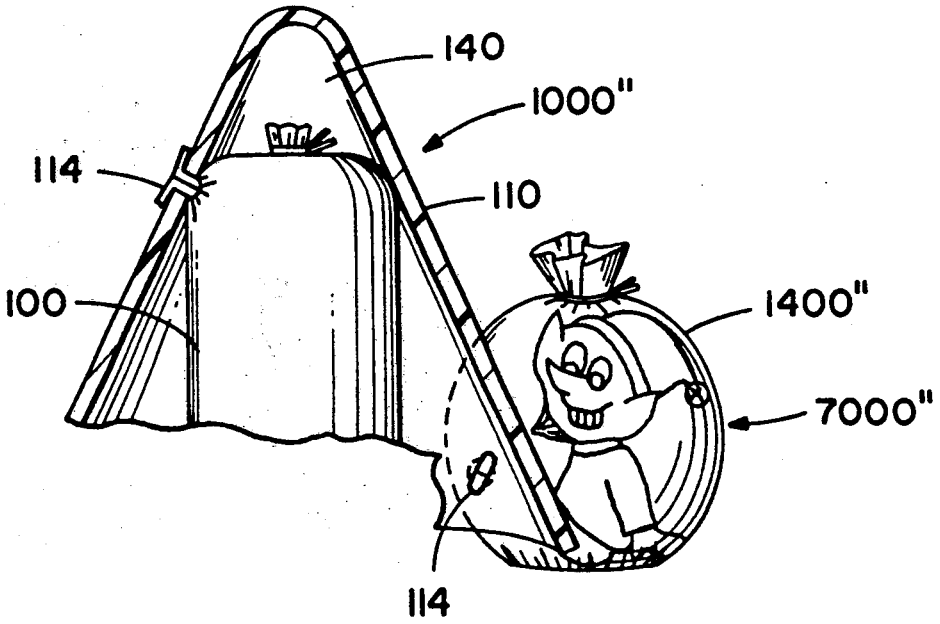

The combined decorative structure of the present invention is assembled with reference to FIGS. 20(A) and 20(B) by constructing the generally pyramidal or inverted conical element of a ghost-like fanciful character 5000 as hereinbefore described in connection with FIG. 5 and by constructing a rounded, generally spherical element of a pumpkin jack-o-lantern 7000 as hereinabove described in connection with FIG. 17(A). The respective elements are placed on the ground, or a platform, either in a spaced apart relationship or in peripherally abutting contact as shown at 113 in FIG. 20(A) and 20(B). If desired, the sheet-like member 110 and bag 210 may be joined by one or more spread clips 114 at a peripherally abutting location 113 in a manner similar to the securing of bag 100 to sheet-like member 110. Also, bag 210 can be secured to the ground (or platform) at its lower peripheral portion 211 by a peg or tee 118 passing through doubled over portion of bag 210 as indicated at 215 in FIG. 20(C). More than one such peg or tee or similar component can be used to stabilize the combination of thematically related elements. It is important that whether spaced apart or abutting, the elements of the combination are positioned to provide, simultaneously, a virtually universally recognizable thematic view. FIG. 21(A)-(B) and 22(A)-(B) show the similar arrangement for assembling the thematic combinations of FIGS. 1(B) and 1(C).

Figure 23A:
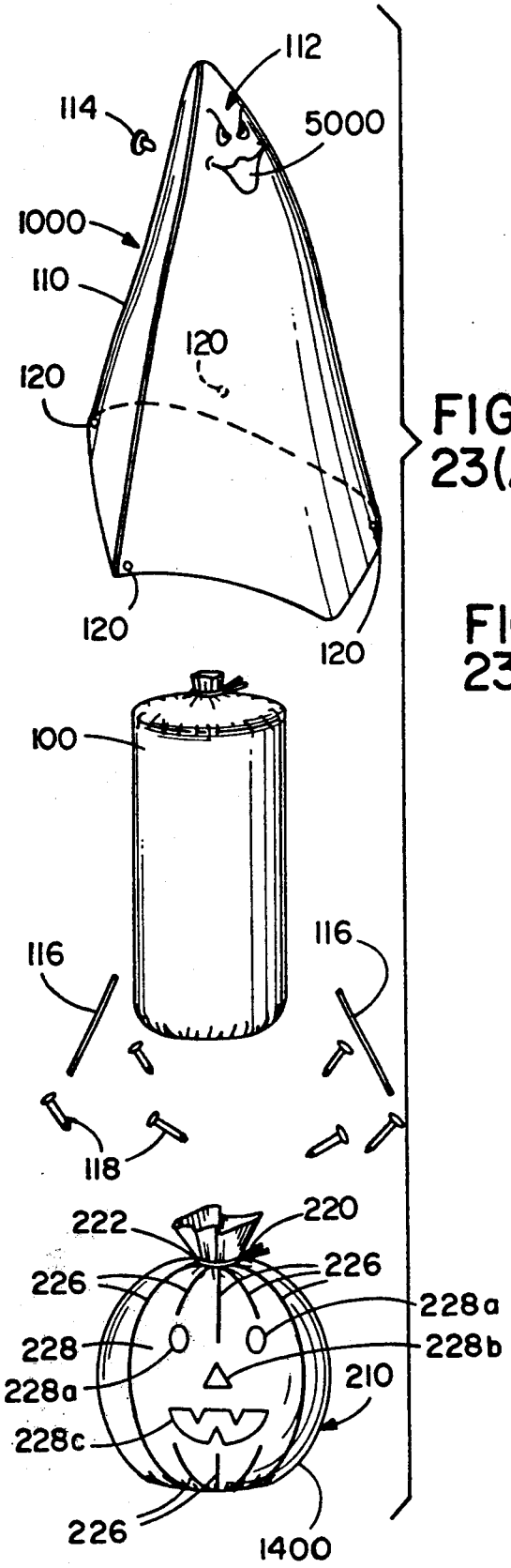
FIGS. 23(A)-23(C) illustrate kits for respective embodiments of the present invention.
Figure 23B:
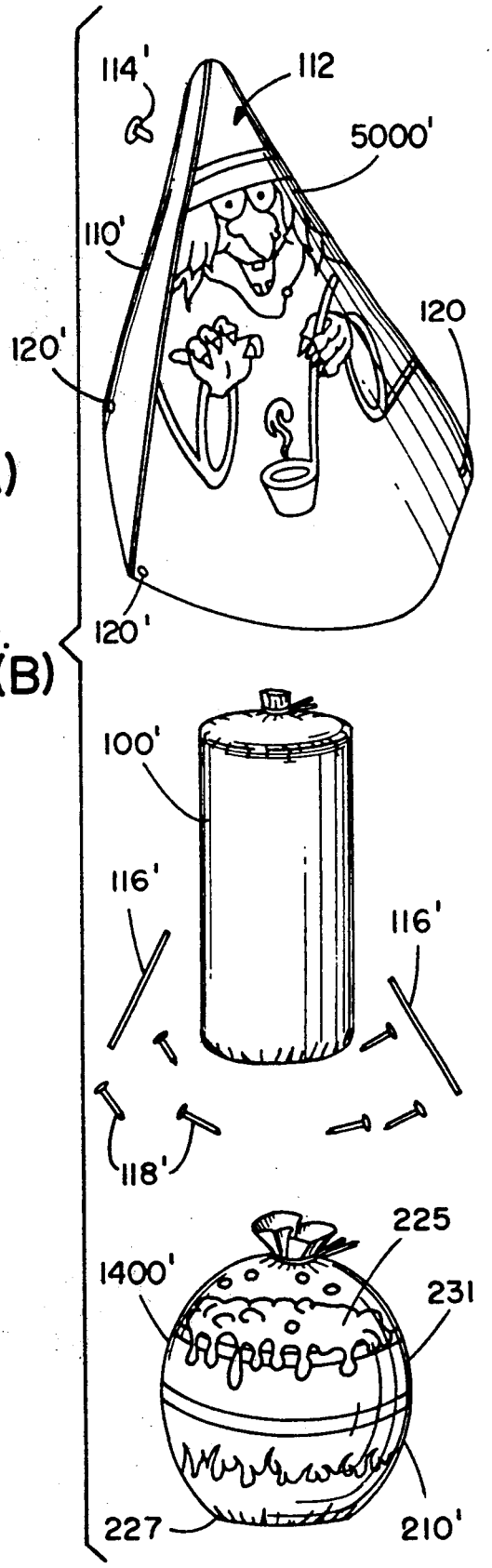
Figure 23C:
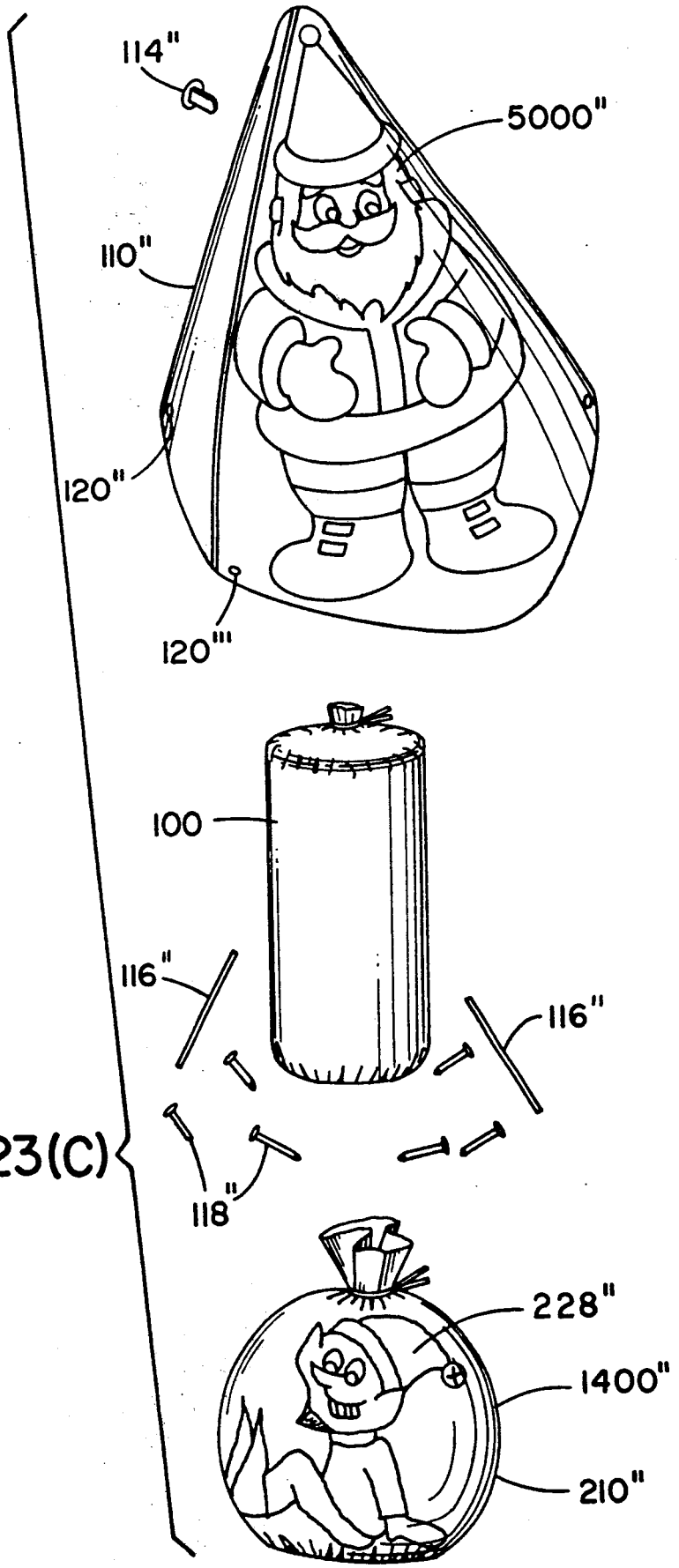

A kit for the combination of a ghost-like, decorative, inverted conical element and a rounded pumpkin jack-o-lantern as shown in FIG. 1(A) is shown in FIG. 23(A) and comprises at least one sheet-like member 110 and at least one support bag member 100, a plurality of ties 116, a plurality of pegs 118 (or other stakes), at least one clip 114 (or tack members of FIG. 13), and a second element bag member 210, e.g. a Halloween jack-o-lantern. The sheet-like member 110 and second element bag member have respective thematically related indicia in place on their outer periphery. Kits for the combinations of FIG. 1(B) and FIG. 1(C) are shown in FIG. 23(B) and 23(C). Individual indicia for the bags 210, 210', 210'' may substantially completely cover one-half of the outer periphery of the bag to present an appropriate thematic relationship with the taller element.

Assembly and use of the kits is as described hereinabove.

While there has been described and illustrated preferred embodiments of the present invention, it is apparent that numerous alterations, additions and omissions may be made without departing from the spirit and scope of the invention as defined in the claims.

What is claimed is:

1. Decorative structures for simulating a common conception of the appearance of a fanciful character or object together with a common conception of the appearance of a thematically related object or character, comprising in combination:

a support bag means having a compressible filling material therein;

a plastic flexible sheet member placed over said support bag means and supported thereby, said sheet member supported by said support bag means forming a first structural element substantially in the shape of a pyramid or an inverted, truncated or pointed cone, and said sheet member having indicia thereon simulating the appearance of a said fanciful character or object;

a plastic flexible bag forming a second structural element, and having a first end and a second end opposite each other, at least said second end being open for receiving filling material therein; and bunching means for bunching together and closing said second end of said flexible bag to form therein a second bunched closed end after filling material is inserted in said bag;

said flexible bag having a substantially rounded shape when filled with filling material and when said second end is bunched by said bunching means, and said bag having indicia thereon simulating appearance of a common conception of an object or character thematically related to the indicia of the flexible sheet member when positioned within viewing distance of said flexible sheet member.

2. The decorative combination structure of claim 1, further comprising:

securing means for securing free ends of said sheet member to a support surface after said sheet member is place over said support bag means.

3. The decorative combination structure of claim 2, further comprising:

fixing means for fixing said support bag member to the support surface to anchor said support bag means to the support surface.

4. The decorative combination structure of claim 3, further comprising:

means for connecting said sheet member to an upper portion of said support bag means to secure said sheet member and said support bag means together.

5. The decorative combination structure of claim 2, further comprising:

means for connecting said sheet member to an upper portion of said support bag means to secure said sheet member and said support bag means together.

6. The decorative combination structure of claim 2, wherein:

said flexible sheet member is draped over said support bag means.

7. The decorative combination structure of claim 2, further comprising:

means for connecting said sheet member to said flexible bag to secure said sheet member and said flexible bag together.

8. The decorative combination structure of claim 1, further comprising:

means for connecting said sheet member to said flexible bag to secure said sheet member and said flexible bag together.

9. A decorative combination structure according to claim 1, wherein:

said first end of said flexible bag is formed in a gusseted Z-lock configuration.

10. A decorative combination structure according to claim 1, further comprising:

second bunching means for said flexible bag, wherein both said first and second ends of said flexible bag are open, and said second bunching means is provided for sealing the first end of said flexible bag.

11. A decorative combination structure according to claim 1, wherein:

said first end of said flexible bag is heat sealed.

12. A decorative combination structure in accordance with claim 1, wherein:

said indicia on said flexible sheet member are selected room indicia representing a ghost, a Santa, and Christmas tree and said indicia on said flexible bag are selected from indicia representing a pumpkin, an elf, and a gift.

13. A decorative combination structure in accordance with claim 1, wherein:

said structural element substantially in the shape of a pyramid or an inverted cone is substantially taller than said flexible bag when filled with filling material.

14. A decorative combination structure in accordance with claim 1, wherein:

said support bag means and said flexible sheet member are shaped and sized such that in placing said flexible sheet member over said support bag means, a space is provided over the support bag means and underneath the flexible sheet member.

15. A decorative combination structure in accordance with claim 14, wherein:

said space is filled with filling material.

16. A kit for forming a decorative structure for simulating a common conception of the appearance of a fanciful character or object in combination with a thematically related object or character comprising:

a support bag adapted to be filled for forming a central structural member of a fanciful character or object;

a plastic flexible sheet member adapted to be placed over said support bag when said support bag is filled, said sheet member adapted to form a structural element substantially in the shape of a pyramid or an inverted cone and having first indicia thereon for simulating the appearance of a fanciful character or object;

at least one connecting member for connecting said sheet member to said support bag at an upper portion of said support bag member;

a plurality of anchoring means adapted to be anchored in the ground or a floor surface for anchoring free ends of said sheet member to the ground or a floor surface at spaced apart locations around a peripheral portion of said sheet member in the vicinity of a lower portion of said support bag;

a plastic flexible bag having an open end for receiving filling material, said plastic flexible bag having second indicia thereon for simulating the appearance of an object or character thematically related to but different from that of said first indicia of the flexible sheet member; and bunching means for bunching together and closing said open end of said plastic flexible bag after filling material is inserted in said plastic flexible bag.

17. A kit in accordance with claim 16, wherein:

said at least one connecting member comprises a plurality of bendable spread clips.

18. A kit in accordance with claim 16, wherein:

said plurality of anchoring means comprises a plurality of golf tees.

19. A kit in accordance with claim 16, wherein:

said bunching means is a plastic-covered flexible metal wire.

20. A kit in accordance with claim 16, wherein:

said flexible sheet member is in the form of two adjacent sheet portions of the same size having a rectangular shape with two intersecting edges with one of said adjacent sheet portions being jointed to the other of said adjacent sheet portions at said intersecting edges.

21. A kit in accordance with claim 16, wherein:

said flexible bag is in the form of a gussetted flexible plastic bag having a closed bottom.

* * * * *